US006354259B2

(12) United States Patent
Fischer et al.

(10) Patent No.: US 6,354,259 B2
(45) Date of Patent: Mar. 12, 2002

(54) CYLINDER LINER FOR COMBUSTION ENGINES AND MANUFACTURING METHOD

(75) Inventors: Manfred Fischer, Leichingen; Rudólf Mundl, Marktoberdorf; Peter Gödel, Freienried; Wolfgang Reichle, Lenningen; Werner Trübenbach, Obergriesbach; Markus Müller, Burscheid; Reinhard Rosert, Dresden, all of (DE)

(73) Assignee: Federal-Mogul Friedberg GmbH (DE)

( * ) Notice: Subject to any disclaimer, the term of this patent is extended or adjusted under 35 U.S.C. 154(b) by 0 days.

(21) Appl. No.: 09/829,610

(22) Filed: Apr. 10, 2001

(30) Foreign Application Priority Data

Apr. 20, 2000 (DE) ..... 100 19 793

(51) Int. Cl.[7] ..... F02F 7/00
(52) U.S. Cl. ..... 123/193.2
(58) Field of Search ..... 123/193.1, 193.2, 123/193.3, 193.4, 193.6; 29/888.048; 428/564, 523

(56) References Cited

U.S. PATENT DOCUMENTS 4,297,976 A * 11/1981 Bruni et al. ..... 123/193.4
5,080,056 A * 1/1992 Kramer et al. ..... 123/193.4
5,303,682 A * 4/1994 Donahue et al. ..... 123/193.2
5,884,600 A * 3/1999 Wang et al. ..... 123/193.6
5,891,273 A * 4/1999 Ruckert et al. ..... 148/523
6,221,504 B1 * 4/2001 Pfeffinger et al. ..... 428/564

* cited by examiner

*Primary Examiner*—Marguerite McMahon
(74) *Attorney, Agent, or Firm*—Reising, Ethington, Barnes, Kisselle, Learman & McCulloch, P.C.

(57) ABSTRACT

A method for the manufacture of a cylinder liner for combustion engines and a cylinder liner which can be manufactured by the method according to the invention are disclosed. The method comprises a thermal spray-deposition, such as by an arc spray-deposition process, of a wearing layer on a supporting body and a spray-deposition of a protective or connecting layer on the wearing layer. The wearing layer comprises a hypereutectic aluminum-silicon alloy and the protective or connecting layer comprises a hypoeutectic aluminum-silicon alloy. A melt retarder of iron, for example, may be interposed between these two layers. The melt retarder comprises a higher melting temperature than the two aluminum-silicon alloys, thereby preventing the wearing layer from partially melting when the cylinder liner is cast into a cylinder bore.

18 Claims, 1 Drawing Sheet

CYLINDER LINER FOR COMBUSTION ENGINES AND MANUFACTURING METHOD

BACKGROUND OF THE INVENTION

1. Field of the Invention

Figure 1:
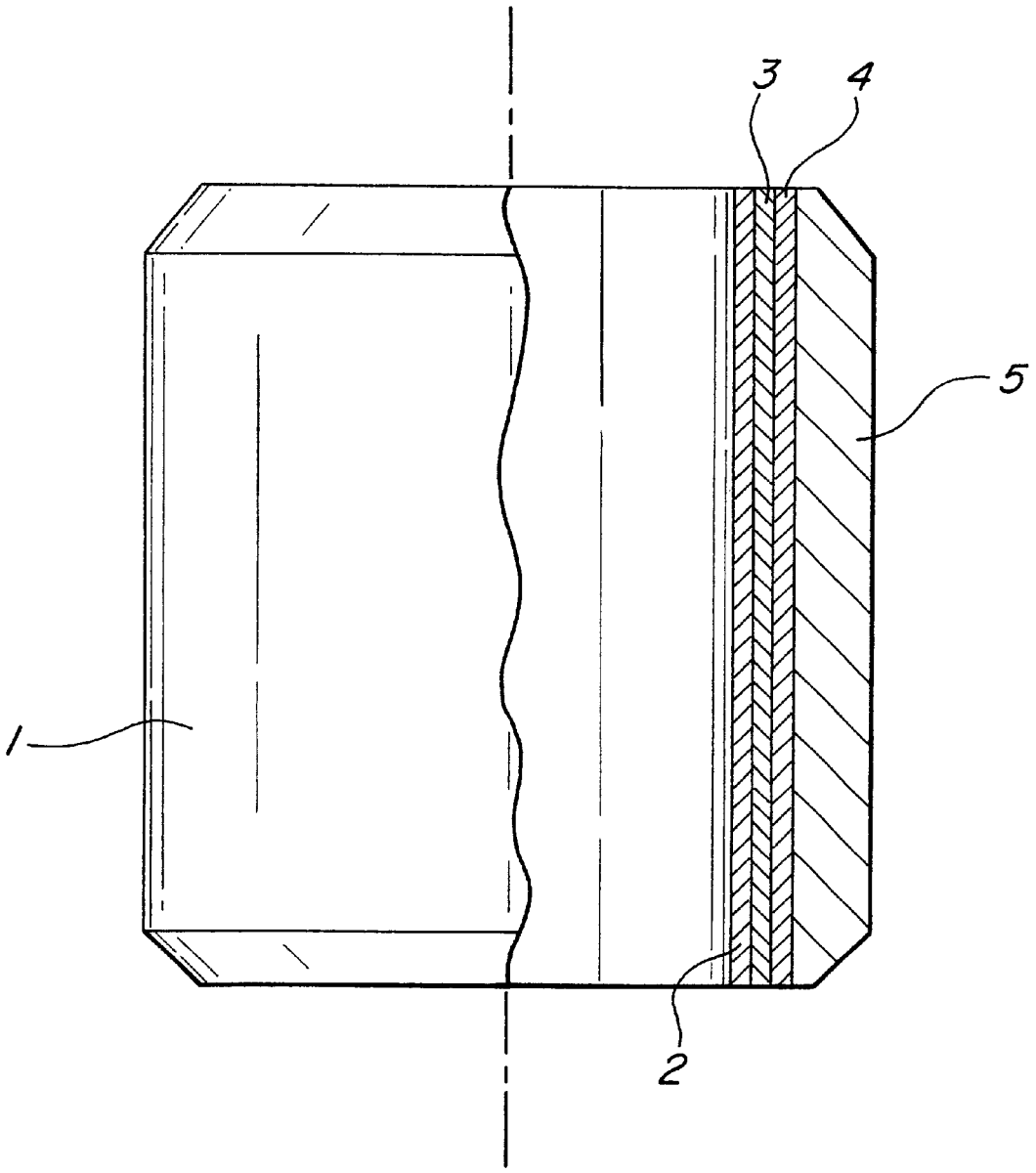

The invention relates to a method for the manufacture of a cylinder liner for combustion engines from light metal by thermal spray-deposition as well as a cylinder liner manufactured by this method.

2. Description of Prior Art

In combustion engines having an engine block made of a cast iron alloy or an aluminum alloy, cylinder liners are usually inserted into the cylinder bores of the engine block. The liners consist of cylindrical pipe sections and their inner surfaces define the combustion space of the combustion chamber of the engine, the inner surfaces also serving as bearing surfaces for the piston rings. Due to the high wear, wear-resistant cast iron or steel alloys or sintered materials are used as liner materials. The bearing surfaces of the liners have to be additionally machined, entailing great expenses, and they have to be provided with wear-resistant coatings if required.

DE 196 05 946 C1 discloses a manufacturing method for cylinder liners which allows a simple and cost-effective manufacture of a highly wear-resistant cylinder liner having an optimally small wall thickness and which allows the subsequent use of the liner as an independent component in an engine block. Using a thermal spray-deposition process, a first wearing layer and thereon a protective layer are deposited on the outer surface of an arbor used as a molding body. The molded cylinder liner is then pulled off the arbor.

In the automotive industry, gray cast iron crankcases of reciprocating engines are increasingly superseded by those made of light metals to reduce the total weight of the motor vehicle and thus to improve fuel utilization. For economic and technical reasons, die casting of low-alloy aluminum such as $AlSi_9Cu_3$ seems to be suited for the manufacture of crankcases of light metal. Unlike atmospherically cast hypereutectic aluminum-silicon alloys such as $AlSi_{17}$ which are established in engine construction but are much more expensive, low-alloy aluminum shows an unsatisfactory frictional and wearing behavior when it is in contact with aluminum pistons and piston rings and is therefore unsuitable as a friction partner. Therefore, even light-metal engines require the casting of tribologically suitable liners of gray cast iron or hypereutectic aluminum-silicon alloys.

DE 197 33 205 A1 discloses a coating of a cylinder face of a reciprocating engine on the basis of iron, aluminum or magnesium including a hypereutectic aluminum-silicon alloy and/or an aluminum-silicon composite and a method for the manufacture of this coating. Here, the layer is directly deposited on the inner wall of the cylinder bore in the engine block. To this end, either an internal burner rotating around the central axis of the cylinder bore which is arranged on a rotating unit is introduced into the cylinder bore and is axially moved, or the internal burner is introduced into the cylinder bore of the rotating crankcase and is axially moved along the central axis of the cylinder bore to spray-deposit the coating on the cylinder wall.

The direct deposition of the coating on the wall of the cylinder bore requires a complex unit including an internal burner which itself rotates within the bore to allow a uniform deposition of the coating. However, the second method of coating in which the internal burner does not rotate requires a rotation of the whole engine block with the cylinder bore around the internal burner. Both methods require a lot of time and money to be translated into practice and to be performed. There is, therefore, a need for a simple method for manufacturing cylinder liners which can be inserted or cast into cylinder bores of light-metal engines.

SUMMARY OF THE INVENTION

It is an object of the invention to provide a simple and cost-effective method for the manufacture of cylinder liners for light-metal engines which have good tribological properties. It is another object of the invention to provide cylinder liners which can be manufactured by the method according to the invention and can be inserted into the cylinder bores of light-metal engines.

These objects are accomplished according to the invention by the features of claims 1 and 16. Advantageous embodiments of the invention are described in the subclaims.

In the method according to the invention, a layer of a hypereutectic aluminum-silicon alloy is deposited on a supporting body of aluminum by a thermal spray-deposition process. In this specification, a hypereutectic aluminum-silicon alloy means an alloy whose silicon content (in the aluminum) is larger than the silicon content (in the aluminum) of an alloy having an eutectic mixing ratio. An eutectic in a binary system means a solids mixture having a particular composition, the eutectic mixture, of two substances which cannot be mixed in the solid state but can be completely mixed in the liquid state. In an equilibrium diagram of a binary system, the point having the lowest possible melting temperature is referred to as the eutectic point. Only at this point, the melt or solution is in equilibrium with the components constituting the melt or solution as solids and with the gas phase. The mixing ratio of the binary system at the eutectic point is the eutectic mixing ratio. In an aluminum-silicon alloy, the proportion of silicon in an eutectic mixture is about 12 percent by weight. A protective or connecting layer of the liner is subsequently molded from a hypoeutectic or eutectic aluminum-silicon alloy which is also deposited by a thermal spray-deposition process. Due to its composition, the protective or connecting layer produces a good connection to the inner wall of a cylinder bore when the cylinder liner is cast in. A hypoeutectic alloy contains less silicon than an eutectic alloy.

Preferably, an arc spray-deposition process is used for the deposition of the two layers of aluminum-silicon alloys.

An arc spray-deposition process in which a filler wire having a closed envelope is used is preferred. The filler wire is filled with a silicon alloy, preferably silicon alloy grains, by directed jarring. In a subsequent drawing and rolling process for reducing the wire to a final diameter, the grains are ground and are thereby uniformly distributed. Therefore, the spray-deposited layer has a homogeneous composition. The drawing and rolling process also solidifies the surface of the wire. The solidification produces a good and uniform transportability of the wire. The composition of the heterogeneous alloy of the spray-deposited layer can be controlled by the composition of the filler wire alloy.

For the wearing layer, a heterogeneous aluminum-silicon alloy having a silicon content ranging from about 12.5 to about 50 percent by weight is preferred. A silicon content range of about 15 to about 40 percent by weight is more preferred. A silicon content range of about 20 to about 30 percent by weight is even more preferred. A silicon content of the wearing layer of about 25 percent by weight is most preferred.

Preferably, the subsequently deposited protective or connecting layer has a silicon content in the range of 2 to 12 percent by weight. A silicon content range of about 3 to about 9 percent by weight is more preferred. A silicon content range of about 4 to about 6 percent by weight is even more preferred. A silicon content of the protective or connecting layer of about 5 percent by weight is most preferred. The low silicon content produces a better connection to the inner wall of the cylinder bore.

Preferably, a melt retarder having a higher melting temperature than the two layers of aluminum-silicon alloys, i. e. the wearing and the protective or connecting layer, is interposed between the two layers of aluminum-silicon alloys. When the cylinder liner is cast into a cylinder bore without a melt retarder, the wearing layer of a hypereutectic aluminum-silicon alloy is partially molten or even may be completely molten up. The melt retarder acts as a thermal barrier or thermal protective wall between the two aluminum-silicon alloys, preventing the hypereutectic aluminum-silicon alloy of the wearing layer from partially or completely melting.

The use of iron as the material for the melt retarder is particularly advantageous, as iron has a markedly higher melting temperature than the aluminum-silicon alloys.

Preferably, the supporting body is made of aluminum or an aluminum alloy.

Preferably, the supporting body is not turned-out until after the cast-in process. This leads to a cost saving, as only a relatively small amount has to be taken off the hypereutectic layer when the cylinder liner is obligatorily turned.

A cylinder liner comprising a wearing layer of a hypereutectic aluminum-silicon alloy and a protective or connecting layer of an eutectic or hypoeutectic aluminum-silicon alloy is preferred.

Preferably, the cylinder liner comprises between the wearing layer and the protective or connecting layer a melt retarder having a higher melting temperature than the two layers of aluminum-silicon alloys which prevents the wearing layer from partially melting when the cylinder liner is cast into a cylinder bore.

Preferably, the melt retarder comprises iron. Iron has a markedly higher melting temperature than alloys of aluminum and silicon which form the wearing layer and the protective or connecting layer.

The invention provides, therefore, a cylinder liner for light-metal engines which can be manufactured simply and cost-effectively by the method according to the invention. Moreover, the cylinder liner according to the invention can be manufactured in such a way that it has optimum wear-resistance levels and tribological properties.

DETAILED DESCRIPTION OF THE PREFERRED EMBODIMENT

The invention will now be explained with reference to an embodiment which is represented in the accompanied drawing. A cylinder liner 1 is composed of four superimposed layers. On the outer circumferential surface of an aluminum supporting body 2, a wearing layer 3 of a hypereutectic aluminum-silicon alloy is deposited by means of a thermal spray-deposition process. In this embodiment, the thermal spray-deposition process is an arc spray-deposition process. Preferably, the wearing layer 3 comprises a silicon proportion in the aluminum-silicon alloy of about 25 percent by weight, the alloy generally having a percent by weight proportion of 60 to 85% Al, 15 to 40% Si, a maximum of 3% Mg, a maximum of 5% Mn and a maximum of 2% B. An Al proportion of about 75% is preferred. On the layer 3, a melt retarder 4 of iron is deposited which prevents the wearing layer 3 from partially melting when the cylinder liner is cast into a cylinder bore. A protective or connecting layer 5 deposited on the wearing layer 5 comprises a hypoeutectic aluminum-silicon alloy having a silicon proportion of about 5 percent by weight, the balance mainly being Al.

Obviously, many modifications and variations of the present invention are possible in light of the above teachings. It is, therefore, to be understood that within the scope of the appended claims, the invention may be practiced otherwise than as specifically described. The invention is defined by the claims.

We claim:

1. A method for the manufacture of a cylinder liner for combustion engines comprising: thermally spray-depositing a wearing layer on a supporting body and subsequently thermally spray-depositing a protective layer on said wearing layer and in which said wearing layer comprises a hypereutectic aluminum-silicon alloy and said protective layer comprises an eutectic or hypoeutectic aluminum-silicon alloy.

2. The method as claimed in claim 1 in which the thermal spray-deposition process comprises an arc spray-deposition process.

3. The method as claimed in claim 2 including using a filler wire having a closed envelope in the arc spray-deposition process wherein said filler wire is filled with a silicon alloy.

4. The method as claimed in claim 1 in which the silicon content of the aluminum-silicon alloy of said wearing layer is about 12.5 percent by weight to about 50 percent by weight.

5. The method as claimed in claim 4 in which the silicon content of the aluminum-silicon alloy of said wearing layer is about 15 percent by weight to about 40 percent by weight.

6. The method as claimed in claim 5 in which the silicon content of the aluminum-silicon alloy of said wearing layer is about 20 percent by weight to about 30 percent by weight.

7. The method as claimed in claim 6 in which the silicon content of the aluminum-silicon alloy of said wearing layer is about 25 percent by weight.

8. The method as claimed in claim 1 in which the silicon content of the aluminum-silicon alloy of said protective layer is about 2 percent by weight to about 12 percent by weight.

9. The method as claimed in claim 8 in which the silicon content of the aluminum-silicon alloy of said protective layer is about 3 percent by weight to about 9 percent by weight.

10. The method as claimed in claim 9 in which the silicon content of the aluminum-silicon alloy of said protective layer is about 4 percent by weight to about 6 percent by weight.

11. The method as claimed in claim 10 in which the silicon content of the aluminum-silicon alloy of said protective layer is about 5 percent by weight.

12. The method as claimed in claim 1 including interposing a melt retarder of a material comprising a higher melting temperature than said wearing layer and said protective layer between said wearing layer and said protective or connecting layer.

13. The method as claimed in claim 12 in which said material of said melt retarder comprises iron.

14. The method as claimed in claim 1 in which said supporting body is made of aluminum or an aluminum alloy.

15. The method as claimed in claim 1 in which said supporting body remains at first in the cylinder liner during casting and is removed following casting.

16. A cylinder liner for cast-in-place installation in a cast cylinder block, comprising a wearing layer of a hypereutectic aluminum-silicon alloy, and a protective layer of an eutectic or hypoeutectic aluminum-silicon alloy superimposed on said wearing layer.

17. The cylinder liner as claimed in claim 16 in which a melt retarder having a melting temperature greater than that of said wearing layer and said protective layer is interposed between said wearing layer and said protective layer.

18. The cylinder liner as claimed in claim 17 in which said melt retarder comprises iron.

* * * * *